US007222463B2

(12) United States Patent
Rotter

(10) Patent No.: US 7,222,463 B2
(45) Date of Patent: May 29, 2007

(54) METHOD OF INSTALLING A ROOF VENTILATION STRIP AND INSTALLATION SYSTEM

(76) Inventor: Martin J. Rotter, 115 Linsmore Ave., Glenside, PA (US) 19038

( * ) Notice: Subject to any disclaimer, the term of this patent is extended or adjusted under 35 U.S.C. 154(b) by 742 days.

(21) Appl. No.: 10/712,592

(22) Filed: Nov. 13, 2003

(65) Prior Publication Data

US 2004/0093812 A1 May 20, 2004

Related U.S. Application Data

(63) Continuation-in-part of application No. 10/101,643, filed on Mar. 20, 2002, now Pat. No. 6,662,510, which is a continuation-in-part of application No. 09/785,077, filed on Feb. 16, 2001, now Pat. No. 6,418,678.

(60) Provisional application No. 60/182,959, filed on Feb. 16, 2000.

(51) Int. Cl.
*E04E 7/00* (2006.01)
*E04H 12/28* (2006.01)

(52) U.S. Cl. ..... 52/199; 52/302.1; 454/365

(58) Field of Classification Search ..... 52/49, 52/57, 90.1, 198, 199, 302.1, 302.3; 454/365
See application file for complete search history.

(56) References Cited

U.S. PATENT DOCUMENTS 4,817,506 A 4/1989 Cashman
5,167,579 A * 12/1992 Rotter ..... 454/365
5,174,076 A 12/1992 Schiedegger et al.
5,352,154 A 10/1994 Rotter et al.
5,425,672 A * 6/1995 Rotter ..... 454/365
5,427,571 A * 6/1995 Sells ..... 454/365
5,561,953 A 10/1996 Rotter
5,704,834 A 1/1998 Sells
6,077,159 A 6/2000 Clayton
6,298,613 B1 * 10/2001 Coulton et al. ..... 52/199
6,418,678 B2 * 7/2002 Rotter ..... 52/199
6,598,353 B1 * 7/2003 Reeves ..... 52/57
6,662,510 B2 * 12/2003 Rotter ..... 52/199
6,913,530 B2 * 7/2005 Morris et al. ..... 454/365
6,981,916 B2 * 1/2006 Coulton ..... 454/365

FOREIGN PATENT DOCUMENTS

JP 5171760 7/1993
JP 5171763 7/1993

* cited by examiner

*Primary Examiner*—Robert Canfield
*Assistant Examiner*—Chi Q. Nguyen
(74) *Attorney, Agent, or Firm*—Volpe and Koenig, PC

(57) ABSTRACT

A roof ventilation system having a strip with an air-permeable portion located adjacent to a ridge slot. Stand-off clips are provided which can be placed over the air-permeable strip at fastener locations which are located on flat portions of the roof panels. The stand-off clip is U-shaped and include a flange at each end of the U-shape. The flanges extend in the same direction. A sealing material may be placed beneath the air-permeable strip at such fastener locations to prevent the ingress of moisture beneath the panels.

17 Claims, 5 Drawing Sheets

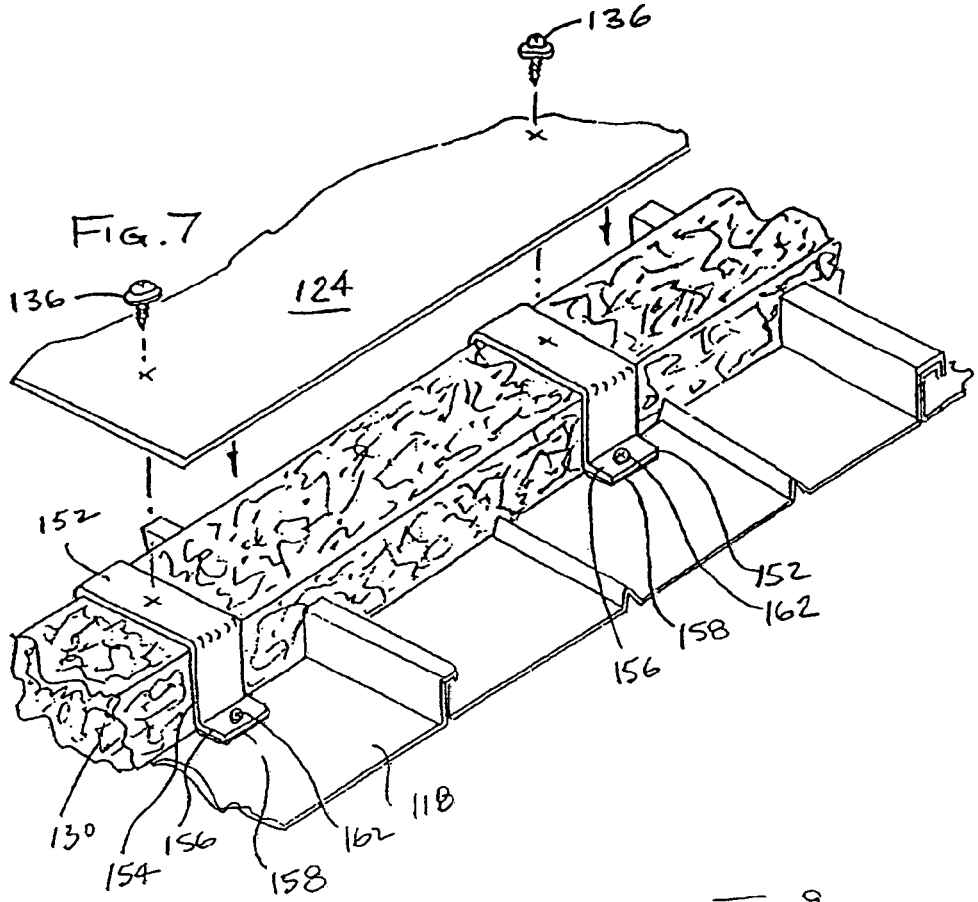
FIG. 7
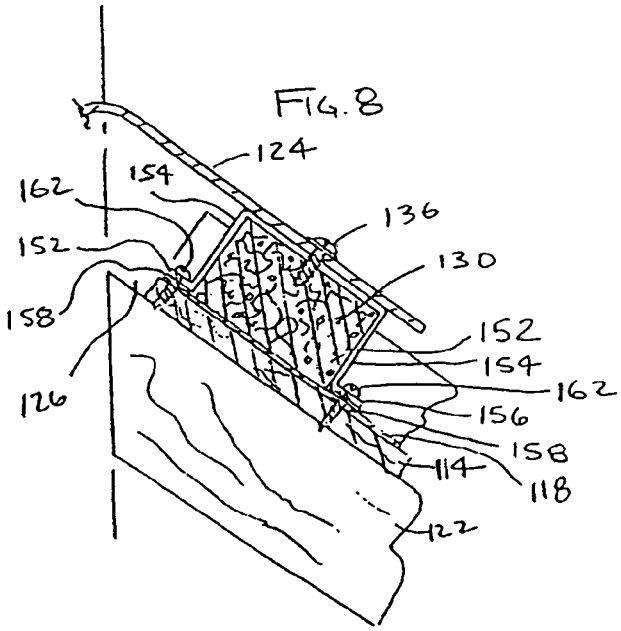
FIG. 8
FIG. 9
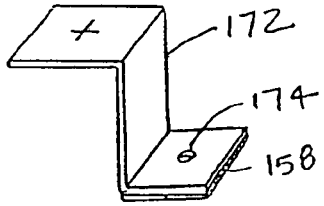
FIG. 10
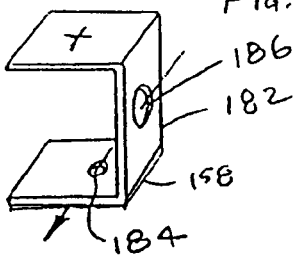

METHOD OF INSTALLING A ROOF VENTILATION STRIP AND INSTALLATION SYSTEM

CROSS-REFERENCE TO RELATED APPLICATIONS

This application is a continuation-in-part of U.S. application Ser. No. 10/101,643 filed Mar. 20, 2002, now U.S. Pat. No. 6,662,510 which is a continuation-in-part of Ser. No. 09/785,077 filed Feb. 16, 2001, now U.S. Pat. No. 6,418,678 which claims the benefit of U.S. Provisional Application No. 60/182,959, filed Feb. 16, 2000.

BACKGROUND

It is known to ventilate the roof structure of a building utilizing a ridge vent. Such vents are created by an open slot running along the roof ridge, which causes ventilation out of the attic by convection air flow and by suction from wind blowing across the roof. A strip of air permeable material is installed over the ridge slot which prevents the ingress of moisture and debris, but allows air flow for ventilation. A ridge cap is then installed over the air permeable strip.

For roofs having contoured shapes, such as roofs having an outer surface formed by a roofing panel having a plurality of stiffening ribs and standing seams, it is known to use a ventilation strip having a surface which includes a plurality of recesses shaped to match the ribs or standing seams of the roof panel. The strip has an air-permeable portion in order to allow airflow. A ridge cap is then installed over the air-permeable strip. Such a system is described in U.S. Pat. No. 5,561,953, which was invented by the present inventor.

A problem has been identified, however, which arises during the installation of a ridge cap over the ventilation strips. The problem is based upon crushing of the air permeable strip in the fastener connection area and/or dimpling or pull through of the fastener due to overdriving. The problem does not exist for some styles of roofs in which fasteners can be installed on or near stiffening ribs. However, when fastening occurs away from a stiffening rib, through the ridge cap, the ventilation strip and into the decking, the ventilation strip can be locally crushed during fastener installation, resulting in an uneven or damaged ridge cap. This problem is further evidenced in roof vent material having greater thicknesses, such as two or more inches, which is starting to see use in profiled ridge vent applications for metal and/or composition roofs. This can lead to a further problem of creating an entry point for moisture through the ridge cap and into the sheathing and internal roof support structure.

SUMMARY

The present invention is generally directed to a system for installing a ridge vent on a contoured roof in which a strip having an air-permeable portion is provided with a surface shape to match the projections of the contoured roof surface. Stand-off clips are provided which can be placed over the contoured, air-permeable strip at fastener locations which are located on flat portions of the roof panels.

In another aspect of the invention, a ridge vent system utilizing contoured air-permeable strips is provided. Stand-off clips are used at fastener locations on flat portions of the roofing panels. A sealing material is placed at fastener locations that penetrate the roofing panels to prevent the ingress of moisture beneath the panels.

BRIEF DESCRIPTION OF THE DRAWING(S)

The foregoing Summary, as well as the following detailed description of the preferred embodiments of the invention will be better understood when read in conjunction with the appended drawings. For the purposes of illustrating the invention, there are shown in the drawings embodiments which are currently preferred. It should be understood, however, that the invention is not limited to the precise arrangements shown.

FIG. 7 is a perspective view of a second type of stand-off clip shown during installation of a roof cap on an air-permeable and resilient strip on a roof panel with standing seams.

FIG. 8 is a cross-sectional view of the roof panel of FIG. 7 showing the stand-off clip in the installed position with the attached roof cap.

FIG. 9 is a perspective view of an alternate embodiment of the second type of stand-off clip in accordance with the invention.

FIG. 10 is a perspective view of a second alternate embodiment of the second type of stand-off clip in accordance with the invention.

DETAILED DESCRIPTION OF THE PREFERRED EMBODIMENT(S)

Figure 1:
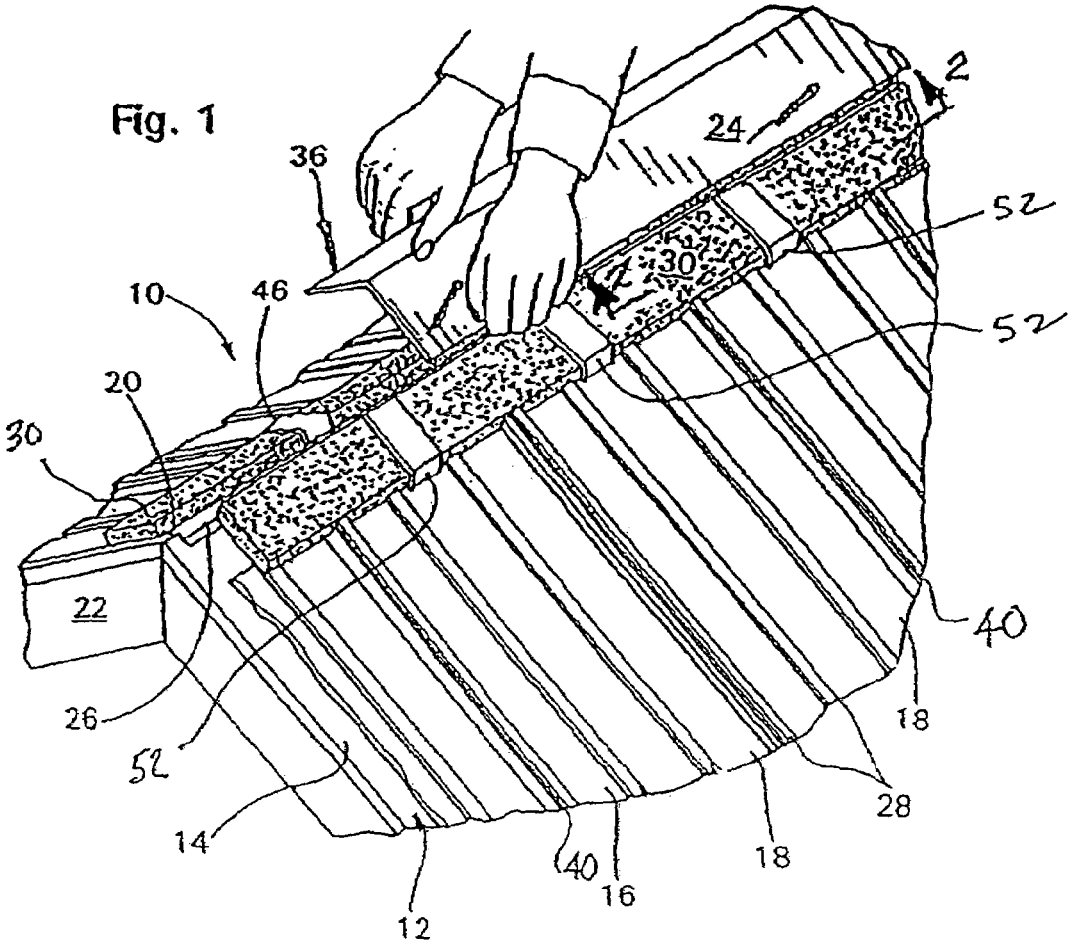
FIG. 1 is a perspective view of a portion of a roof ridge showing the installation of a roof ridge vent with a contoured air-permeable and resilient strip and stand-off clips in accordance with the present invention.

Certain terminology is used in the following description for convenience only and is not considered limiting. The words "right," "left," "lower," and "upper" designate directions in the drawings to which reference is made. This terminology includes the words specifically noted above, derivatives thereof and words of similar import. Additionally, the terms "a" and "one" are defined as including one or more of any referenced item unless specifically noted.

Referring now to FIG. 1, a roof venting system 10 in accordance with the present invention is shown. The roof venting system 10 is described in relation to a sloped roof 12 having a decking 14 which is covered by an outer, weatherproof sheet 16, preferably formed by a plurality of contoured roof panels 18. The contoured roof panels 18 may be made of metal, fiber glass or any other suitable material and preferably include a plurality projections, such as stiffening ribs 28, with the ribs located at the edges of the contoured roof panels 18 being used to form a standing seam 40 between adjacent panels.

The upper row of decking 14 terminates approximately ¾ to 1 inch short of the crest of the roof ridge thereby defining a vent slot 26. The vent slot 26 may also be created during construction of the roof or may be retrofitted using a circular saw to cut a slot in the decking 14.

Figure 2:
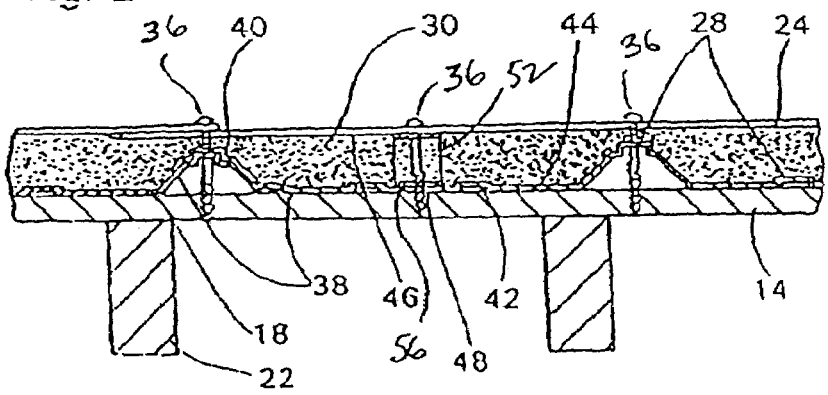
FIG. 2 is a cross-sectional view taken along line 2—2 in FIG. 1.
Figure 3:
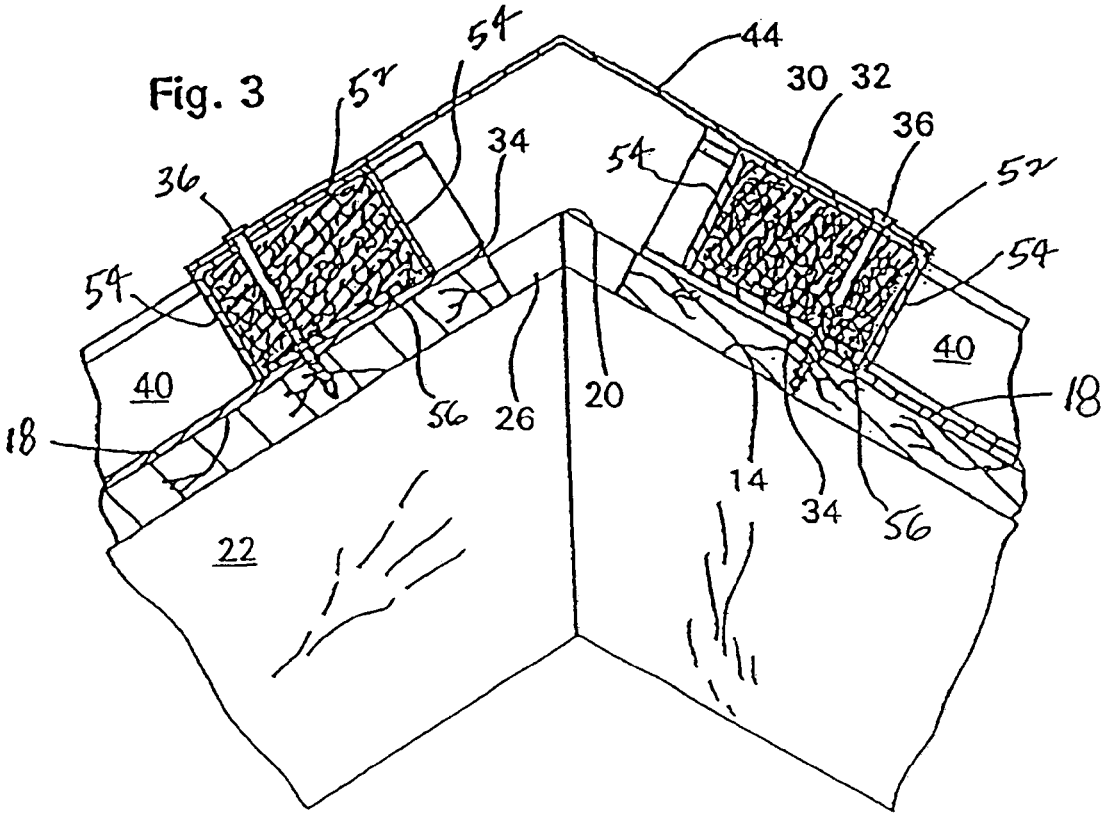
FIG. 3 is a cross-sectional view of a portion of the roof ridge shown in FIG. 1.
Figure 4:
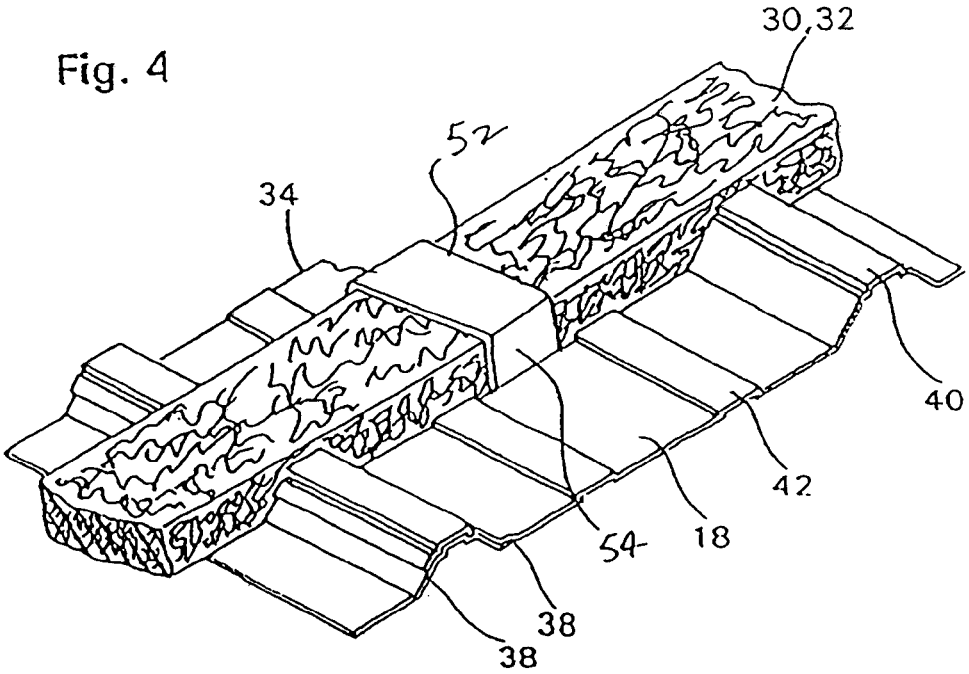
FIG. 4 is an enlarged perspective view of the air-permeable and resilient strip on the contoured roof panels with the stand-off clip positioned at a fastener location.

A strip 30, having an air permeable portion to allow ventilation, is preferably shaped on its lower surface 44 to match the contours of the roof panes 18. Preferably, one strip 30 is provided on either side of the vent slot 26. The ridge cap 24 is secured to the decking 14 over the strips 30 using a series of fasteners 36. As shown in FIG. 2, preferably the screw fasteners 36 are located at a standing seam 40 or at a stiffening rib 28, if possible. However, fasteners 36 are often required at locations along the contoured roof panels 18 at the spacing of 18–24 inches in order to ensure that the ridge cap 24 is securely held in position. At these intermediate, non-rib locations which fall in the flat field area of the contoured roof panels 18, it is possible to over-drive the screw fasteners 36, thereby bending the ridge cap 24 and over compressing the strip 30. In the preferred embodiment, the fasteners are screws, however, those skilled in the art will recognize other suitable fasteners, such as nails, can be used for the application.

As shown in detail in FIGS. 1 through 4, preferably a stand-off clip 52 is provided at these locations in order to prevent the screw fasteners 36 from over compressing the strip 30. Each stand-off clip 52 is preferably U shaped and is dimensioned to fit over the strip 30. The legs 54 of the stand-off clip 52 can be provided over-sized and trimmed to the proper size at installation. Alternatively, different size stand-off clips 52 can be provided to match the different thicknesses of the strip 30 which may be utilized. In the preferred embodiment, the stand-off clip 52 is made of galvanized metal. However, those skilled in the art will recognize from the present disclosure that other suitable materials could be used to make the stand-off clip 52. In a preferred embodiment, the stand-off clip 52 is approximately 3 in. wide and the legs are approximately 2 in. long such that they can be trimmed to size at installation.

Because the stand-off clips 52 are typically utilized in the flat field area of the contoured roof panels 18, preferably a sealing material 56 is provided at each stand-off clip location. The sealing material 56 may be a strip of butyl rubber, having an adhesive located on one side, or any other suitable sealing material compatible with the particular contoured roof panels 18. The sealing material 56 may be provided in pre-cut pieces or partially perforated strips which can be separated from a sheet of release paper, and placed in position under the strip 30 at each fastener location which does not correspond to a sufficiently large stiffening rib 20 to prevent over-driving of the fastener 36.

While the strip 30 must have at least a portion that is air-permeable to allow the passage of air to ventilate the roof, preferably the entire strip 30 is an air-permeable material 32. Although other air-permeable-materials could be used, the preferred air permeable material 32 is a strip of non-woven synthetic fiber matting, as described in the inventor's prior U.S. Pat. No. 5,167,579, which is incorporated herein by reference as if fully set forth.

Figure 5:
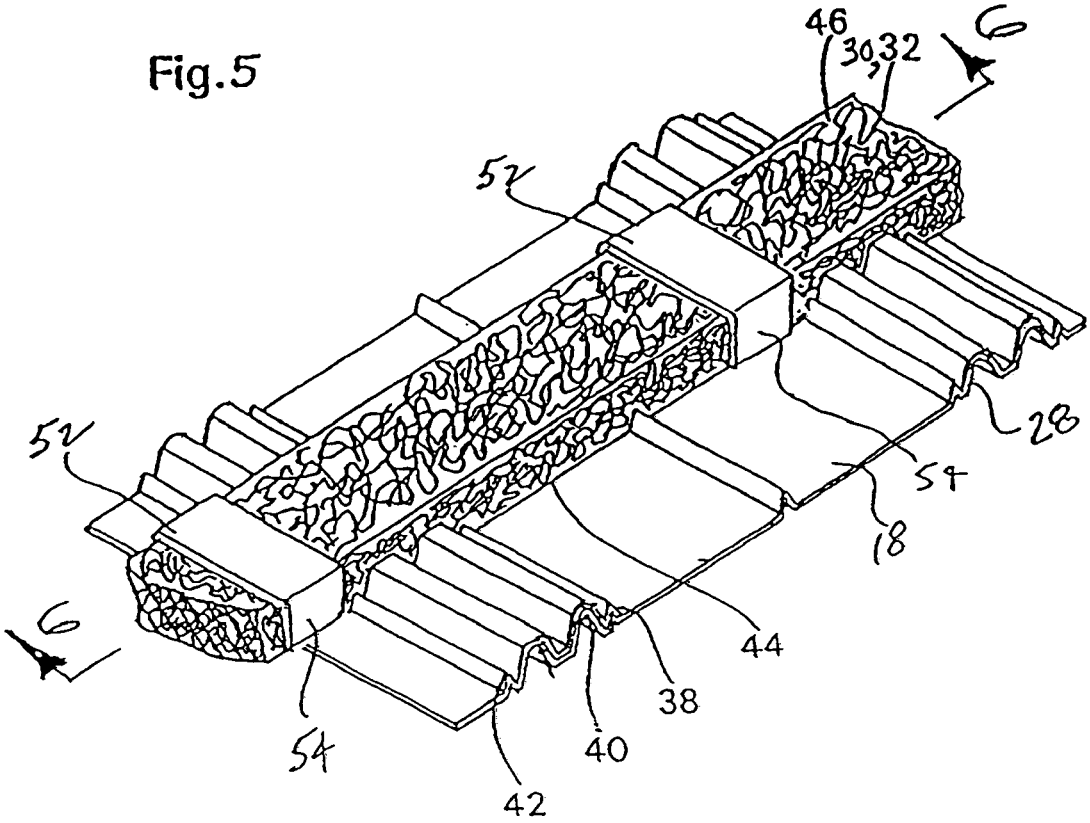
FIG. 5 is an enlarged perspective view of an alternative embodiment of the air-permeable and resilient strip on alternate roof panels with the stand-off clips being utilized at each of fastener location.
Figure 6:
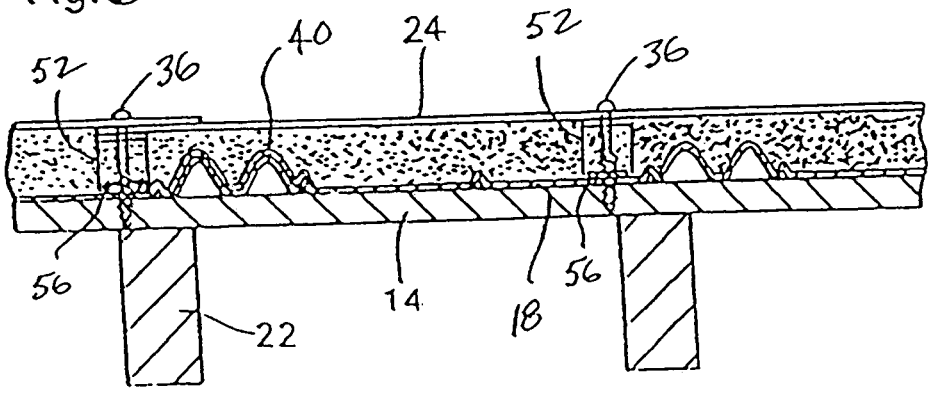
FIG. 6 is a cross sectional view taken along line 6—6 in FIG. 5.

While the stand-off clips 52 are only located in the areas on the contoured roof panels 18 which do not include a large stiffening rib 28 or standing seam 40, as shown in the alternate embodiment of the roofing system in FIGS. 5 and 6, certain types of roof panels 18 include ribs 28 and standing seams 40 which are too small to reliably be penetrated with the fastener 36. In such installations, the stand-off clips 52 are located in the flat area of the roofing panel 18 adjacent to the ribs 20 or standing seams 40 at the desired spacing required for holding the ridge cap 24 in place. Preferably, the sealing material 56 is also provided at these locations in order to prevent moisture ingress at the positions where the screw fastener 36 penetrates the contoured roof panel 18.

The strip 30 completely fills the space between the contoured roof panel 18 and the ridge cap 24, with the ridge cap 24 engaging the planer upper surfaces 46 of the strip 30. The lower surface 44 of the strip 30 matches the contour of the roof panels 18. Those skilled in the art will recognize from the present disclosure that different contours in the strip 30 will be required and that the thickness of the strip 30 may vary, depending upon the height of the ribs 20 and standing seams 40.

In order to install the ridge vent in accordance with the present invention, after the contoured roof panels 18 have been installed on the decking 14, the strips 30 are placed along each side of the open slot 26 running along the ridge. The stand off clips 52 are placed at the desired spacing over the strip 30 at the fastener locations for the ridge cap 24 which do not fall on standing seams 40 or stiffening ribs 28 which can receive a fastener 36 for holding the ridge cap 24 in position. Preferably, the sealing material 56 is placed on the surface of the contoured roof panel 18 under each stand-off clip 52. The ridge cap pieces 34 are then placed in position over the stand-off clips 52 and the strips 30. The fasteners 36 are then driven through the ridge cap 24, the stand off clips 52, the strip 30, the contoured roof panels 18 and into the decking 14 at the desired locations along the ridge cap 24 to hold the ridge cap 24 in position. The fasteners 36 may also be driven through the ridge cap 24, the strip 30 and standing seams 40 or ribs 28 of sufficient size.

Referring now to FIGS. 7 and 8, a second type of stand-off clip 152 in accordance with the present invention is shown. The second type of stand-off clip 152 is installed over the air permeable and resilient strip 130 located along the slot 126 of a roof peak in a similar manner to the stand-off clip 52 in accordance with the first embodiment of the invention. The stand-off clip 152 is generally hat-shaped, and includes two legs 154 and bottom flanges 156 though which attachment screws 162 are preferably installed. Preferably, the bottom flanges 156 have pre-drilled holes for the attachment screws 162. Alternatively, self-drilling screws could be utilized. The screws 162 preferably extend through the roof panel 118 and into the decking 114. The stand-off clips 152 are preferably located on the flat part of the contoured roof panel 118 and may be adjacent to the sanding seam sections.

In order to install the roof cap 124 over the air permeable and resilient strip 130, the stand-off clips 152 are first installed. The roof cap 124 is then placed in position and screws 136 are installed through the roof cap 124 and into the upper surface of the stand-off clips 152. This has the advantage of using shorter length screws, especially when the roof vent material 130 is thick.

As shown in FIGS. 7 and 8, preferably a sealing material 158 is located under the bottom flanges 156 where the fasteners 162 penetrate the contoured roof panel 118 and into the decking 114. While the installation is illustrated in the area of a rafter 122, those skilled in the art will recognize that this can be at any location along the decking 114. The sealing material 158 may be pre-installed on the bottom flanges 156 and seals around the opening in the roof panel to prevent the ingress of moisture. It is not necessary to seal around the hole 136. However, a sealing material may also be provided on the upper surface of the stand-off clip 152, if desired. Different height of stand-off clips 152 may be provided for use with various different thickness of roof vent material 130.

Alternatively, the screws 162 can be omitted, and screws 136 may be utilized which are long enough to be driven through the roof cap 124, the stand-off clips 152, the vent material 130, and into the roof panel 118 and decking 114.

Referring now to FIG. 9, and alternate embodiment of the second type of stand-off clip 172 is shown. The alternate embodiment provides a Z-shaped clip 172 which is installed in a similar manner to the stand-off clip 152. Preferably, the bottom flange of the Z is installed on the down-slope side of the air-permeable and resilient strip 130 utilizing a threaded fastener. However, it may also be installed on the upslope side, which has the advantage of placing the fastener under the ridge cap. The fastener is preferably installed in a pre-formed hole 174 in the bottom flange. A sealing material 158 is preferably also located on the bottom side of the bottom flange for sealing around the fastener upon installation. The Z-shaped stand-off clip 172 may be provided with various heights for use with particular heights of air-permeable and resilient strips 130, depending upon the particular roofing application. The upper surface of the Z is preferably large enough to allow an installer to install fasteners 136 through the roof cap 124 and into the upper surface of the Z without difficulty. Preferably, the width of the Z is 1.5 inches or greater. However, other widths could be used.

Referring now to FIG. 10, a second alternate embodiment of the second type of stand-off clip is shown. The stand-off clip 182 is generally U-shaped and includes a bottom flange for attaching to the roof. Preferably, the U-shaped stand-off clip 182 is installed on the down-slope side of the air permeable and resilient strip 130. A pre-drilled hole 184 is preferably provided in the bottom flange for attachment of a screw through the contoured roof panel 118 and into the decking 114. The sealing material 158 is preferably located on the bottom side of the bottom flange for sealing around the screw during installation. Preferably a clearance hole 186 is provided in the generally upwardly extending portion of the U-shaped stand-off clip 182 in order to allow a screw to be installed downwardly and inwardly through the clearance hole 186 in the generally vertically extending portion of the U-shaped stand-off clip 182. This can be installed prior to placement of the air-permeable and resilient strip 130 or may be installed through the air-permeable and resilient strip 130. The upper flange provides a suitable target area for installing the fastener 136 through the cap 124 for anchoring the cap 124 to the stand-off clip 182.

Figure 11:
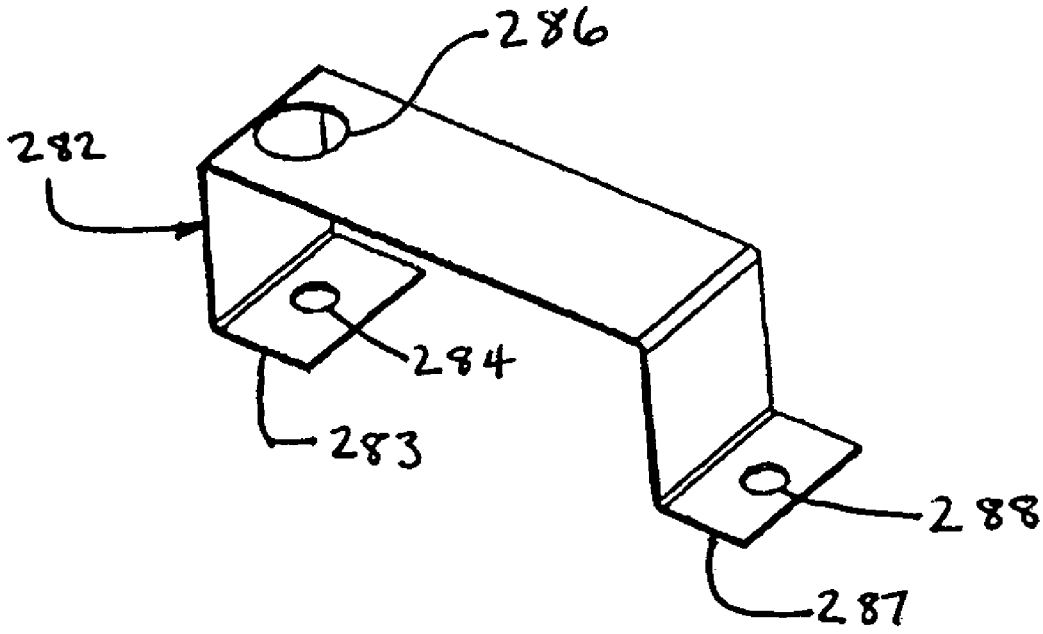
FIG. 11 is a perspective view of a third alternate embodiment of a stand-off clip in accordance with the invention.

Referring now to FIG. 11, a third alternate embodiment of the second type of stand-off clip is shown. The stand-off clip 282 has a generally U-shaped cross section with a first flange 283 and a second flange 287 extending from the ends of the U-shape in the same direction. A first pre-drilled hole 284 and second pre-drilled hole 288 are preferably provided in the flanges for attachment of a screw through the contoured roof panel 118 and into the decking 114. The sealing material 158 is preferably located on the bottom side of the flanges 283, 287 for sealing around the screw during installation. Preferably a clearance hole 286 is provided in the upper portion of the U-shaped stand-off clip 282 in order to allow a screw to be installed downwardly through the clearance hole 286 and extending through the first pre-drilled hole of the U-shaped stand-off clip 282. This can be installed prior to placement of the air-permeable and resilient strip 130 or may be installed through the air-permeable and resilient strip 130. The upper flange provides a suitable target area for installing the fastener 136 through the cap 124 for anchoring the cap 124 to the stand-off clip 282.

The stand-off clips may be made of various materials, such as stainless steel or galvanized metal and may be bent-up into the desired shape. Alternatively, the stand-off clips may be extruded or cast from a desired material, such as stainless steel or steel which can then be galvanized, or may be extruded of aluminum or any other suitable material.

While the preferred embodiments of the invention have been described in detail, the invention is not limited to the specific embodiments described above, which should be considered as merely exemplary. For example, the stand-off clips can be used in conjunction with other types of roofs, such as composition roofs, as well as with other types of air-permeable strips 30 in order to prevent over-driving of the fasteners through the ridge vent. Further modifications and extensions of the present invention may be developed, and all such modifications are deemed to be within the scope of the present invention as defined by the appended claims.

What is claimed is:

1. A roof ventilation system comprising:

a strip having an air permeable section located adjacent to a ridge slot of a roof structure having at least one projecting portion, with the strip extending continuously over the at least one projecting portion;

a U-shaped stand-off clip located over at least a portion of the strip, having a U-shaped body, a first flange extending from a first end of the U-shaped body and a second flange extending from the second end of the U-shaped body, the first flange and the second flange extend in the same direction with respect to each other;

a ridge cap located over the ridge slot and at least a portion of the strip;

first fasteners driven through the first and second flanges of the clip and the roof structure; and at least a second fastener driven through the cap and the clip.

2. The roof ventilation system of claim 1, wherein the strip is formed to fit an exterior roof surface profile.

3. The roof ventilation system of claim 1, wherein the strip has a depression in a contact area of each of the stand-off clips.

4. The roof ventilation system of claim 1, wherein the fasteners are threaded.

5. The roof ventilation system of claim 1, wherein the roof structure comprises roof panels having raised sections as the at least one projecting portion, and additional fasteners are located at the roof panel raised sections.

6. The roof ventilation system of claim 1, wherein the roof structure comprises roof panels having raised sections as the at least one projecting portion, and the clips are located between the roof panel raised sections.

7. The roof ventilation system of claim 1, wherein the first flange has a first hole therethrough for receiving one of the first fasteners.

8. The roof ventilation system of claim 7, wherein the stand-off clip has a second hole therethrough for receiving another one of the first fastener.

9. The roof ventilation system of claim 7, wherein the second flange has a clearance hole located in an upper portion of the U-shaped body to allow passage of the first fastener for the second flange therethrough.

10. A roof ventilation system comprising:

a strip having an air permeable section located adjacent to a ridge slot of a roof structure having at least one projecting portion, with the strip extending continuously over the at least one projecting portion;

a U-shaped stand-off clip located over at least a portion of the strip at a location away from the at least one projecting portion, wherein the U-shaped clip has a U-shaped body with a first flange extending from a first end of the U-shaped body and a second flange extending from the second end of the U-shaped body, and wherein the first flange and the second flange extend in the same direction with respect to each other;

a ridge cap located over the ridge slot and at least a portion of the strip;

at least a first fastener driven through the clip and the roof structure.

11. The roof ventilation system of claim 10, wherein the first fastener is also driven through the ridge cap.

12. The roof ventilation system of claim 10, further comprising a second fastener driven through the ridge cap and the clip.

13. The roof ventilation system of claim 10, wherein the strip is formed to fit an exterior roof surface profile.

14. The roof ventilation system of claim 10, wherein the first flange has a first hole therethrough for receiving the first fastener.

15. The roof ventilation system of claim 14, wherein the second flange has a second hole therethrough for receiving another fastener.

16. The roof ventilation system of claim 15, wherein the stand-off clip has a clearance hole located in an upper portion of the U-shaped body to allow passage of the fastener for the second flange therethrough.

17. The roof ventilation system of claim 10, wherein a sealing material is located on a bottom surface of the bottom flange.

* * * * *